United States Patent [19]

Francis

[11] 4,425,212

[45] Jan. 10, 1984

[54] ELECTROPLATING DEVICE

[76] Inventor: William L. Francis, 18 Chimney Wood, Floyd Knobs, Ind. 47119

[21] Appl. No.: 323,441

[22] Filed: Nov. 20, 1981

[51] Int. Cl.[3] ..... C25D 17/06; C25D 17/28

[52] U.S. Cl. ..... 204/202; 204/224 R

[58] Field of Search ..... 204/224 R, 200, 201, 204/202, 203

[56] References Cited

U.S. PATENT DOCUMENTS

| | | | |
|---|---|---|---|
| 3,904,489 | 9/1975 | Johnson | 204/224 R |
| 4,032,414 | 6/1977 | Helder | 204/224 R |
| 4,035,245 | 7/1977 | Danneels | 204/224 R |
| 4,155,815 | 5/1979 | Francis | 204/15 |
| 4,186,062 | 1/1980 | Eidschun | 204/224 R |
| 4,240,880 | 12/1980 | Tsuchibuchi | 204/15 |

*Primary Examiner*—T. M. Tufariello

*Attorney, Agent, or Firm*—Edward M. Steutermann

[57] ABSTRACT

Apparatus for continuous electroplating of selected portions of elongate metallic articles. The articles are carried in spaced relation between cooperating longitudinally aligned first and second conveyor belts with the portion of the article to be electroplated internally and/or externally extending downwardly from the belts with a contact portion of the article extending upwardly from the belts where the portion to be electroplated is then passed through an electroplating station including selected electroplating solution in a cell in contact with the electroplating solution while a direct current potential is applied between a contact strip in contact with the contact portion of the article and the electroplating solution.

15 Claims, 21 Drawing Figures

ELECTROPLATING DEVICE

BACKGROUND OF THE INVENTION

The present invention relates to the art of electroplating and particularly to the art of electroplating small articles, for example small metallic parts used as contacts in the electronics industry and more particularly to the art of goldplating electronic components.

The growth and increased sophistication of the electronics industry has led to the need for electroplated components and particularly contacts of various description electroplated priamarily with gold to prevent corrosion and erosion of contact areas and maintain reliable electrical conductivity of the components.

Gold has become recognized as the leading plating material because of its relative unalterability, good solderability and low contact resistance.

In some cases plating of such contacts has been accomplished by so called "barrel plating" techniques where the articles are tumbled in a barrel as the plating is applied.

Such techniques are expensive because of the increased price of gold coupled with the use of excess material because such techniques lead to plating unnecessary areas and overplating. Accordingly, the use of techniques to plate only contact surfaces have come to be appreciated.

One prior art arrangement for selective plating is shown in U.S. Pat. No. 3,904,489 which utilizes a porous felt type applicator which is used to apply the electroplating solution to the parts which are carried by a continuous belt by insertion therethrough.

Another prior art arrangement which is an improvement in the aforenoted arrangement is shown in U.S. Pat. No. 3,966,581.

Still another prior art arrangement is shown in U.S. Pat. No. 4,155,815-Francis, et al. where endless tractor belts are utilized to hold printed circuit boards for selective electroplating.

No prior art devices are known to accomplish continuous electroplating of selected articles where the articles are continuously carried in selected orientation through electroplating bath to electroplate only selected portions thereof while electrical contact is maintained between internal from a contact strip in contact with a first portion of the article while the downwardly depending portion of the article to be electroplated is immersed in the electroplating solution.

SUMMARY OF THE INVENTION

The present invention provides a straightforward economical means for electroplating selected areas of small metallic articles.

Further, devices within the scope of the present invention provide means to rapidly and efficiently electroplate selected areas of metallic articles without waste of the electroplating solution or overplating.

Heretofore, prior art methods and apparatus have been directed to electroplating the outside of articles, such as electrical contacts. No effective means have been available to plate the inside surface of tubular articles, as sometimes utilized in the electronics industry without plating virtually the entire article. The present invention further provides apparatus and method for effectively plating only the internal contact area of electrical connectors.

More particularly, the present invention provides an apparatus for continuous electroplating of selected portions of elongate metalic articles. The articles are carried in spaced relation between cooperating longitudinally aligned first and second conveyor belts with the portion of the article to be electroplated extending downwardly from the belts with a contact portion of the article extending upwardly from the belts where the portion to be electroplated is then passed through an electroplating station including selected electroplating solution in a cell in contact with the electroplating solution while a direct current potential is applied between a contact strip in contact with the contact portion of the article.

BRIEF DESCRIPTION OF THE DRAWINGS

One example in accordance with the present invention is disclosed in the accompanying drawings where:

FIGS. 13A–13E are elevational views of parts which can typically be plated in apparatus in accordance with the present invention while;

DETAILED DESCRIPTION OF THE DRAWINGS

Figure 1:
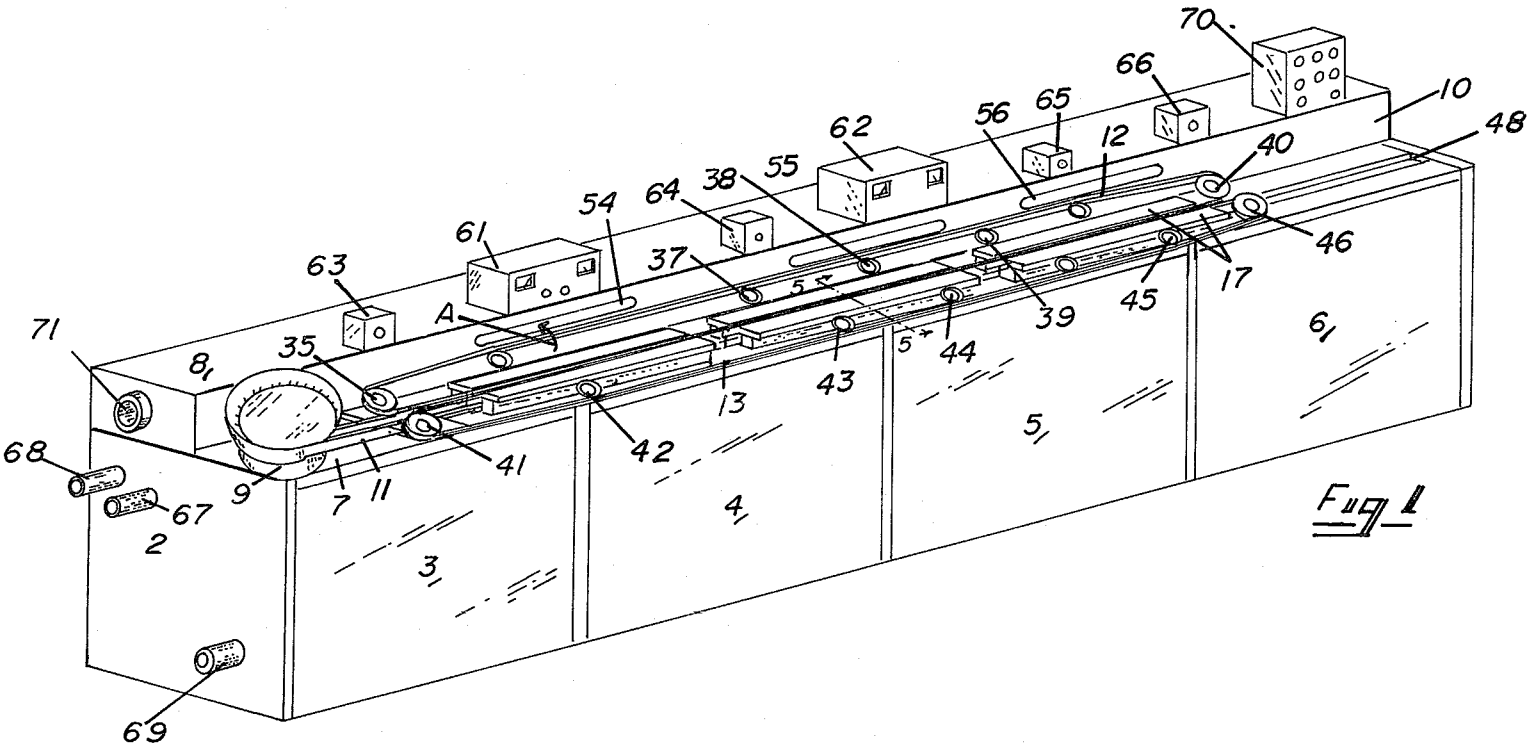
FIG. 1 is a perspective view of an example of an arrangement in accordance with the present invention.
Figure 11:
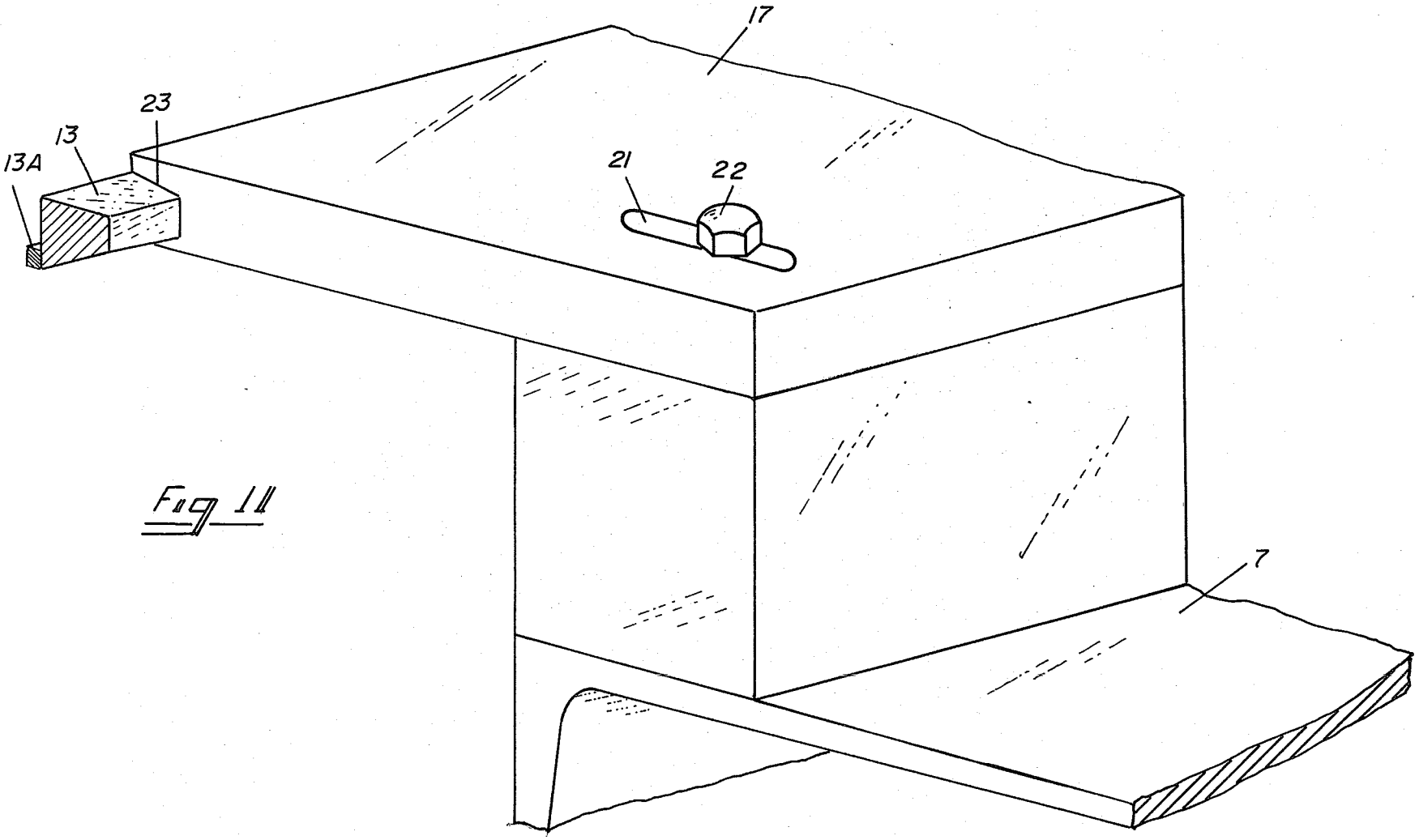
FIG. 11 is a perspective view of an example of a belt guide in accordance with one feature of the present invention.
Figure 13B:
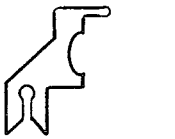
Figure 13D:
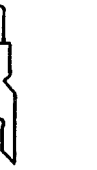
Figure 13A:
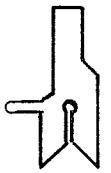
Figure 13C:
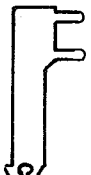
Figure 13E:
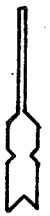

Referring first to FIG. 1 an arrangement is shown including a frame assembly 1 to support cover panels including, for example, panels 2–6 and corresponding panels on the other sides of the device (not shown). A top 7 is provided along with a shelf 8 supported by the frame assembly. A feeder 9 for example a Syntron vibrating feeder FMC Corporation can be placed on top 7 to orient and individually feed parts to be plated through a chute 11 in generally vertical relation to a belt assembly described hereinafter. The belt assembly includes opposed belts 12 and 13. As described hereinafter belt 13 travels around sprockets 41–46 while belt 12 travels on sprockets 35–40 to receive the parts from chute 11 at a nip 16 formed between feed belts 12–13 which are disposed in contiguous relation for a portion of the belt travel as illustrated in FIG. 1 to convey the parts through the various stations of the electroplating system as described hereinafter. Belt guides 17 as shown in FIG. 11 are provided to be positioned on top 7 to hold belts 12 and 13 in position for transport of the articles to be processed where, as shown in FIG. 11, which illustrates a typical guide 17, it includes a base 18 secured to top 7 and a guide 19 secured thereto by means of a bolt 22 secured in a slot 21 for adjustment. A groove 23 is provided to receive the belt, for example belt 13 to guide the belt in contiguous relation with belt 12 (not shown) in transit through the plating stations. It will be recognized that similar support arrangements are provided for belt 12. On the return leg to pickup new parts to be plated, belts 12 and 13 travel on pulleys 35–40 and 41–46 respectively.

Figure 5:
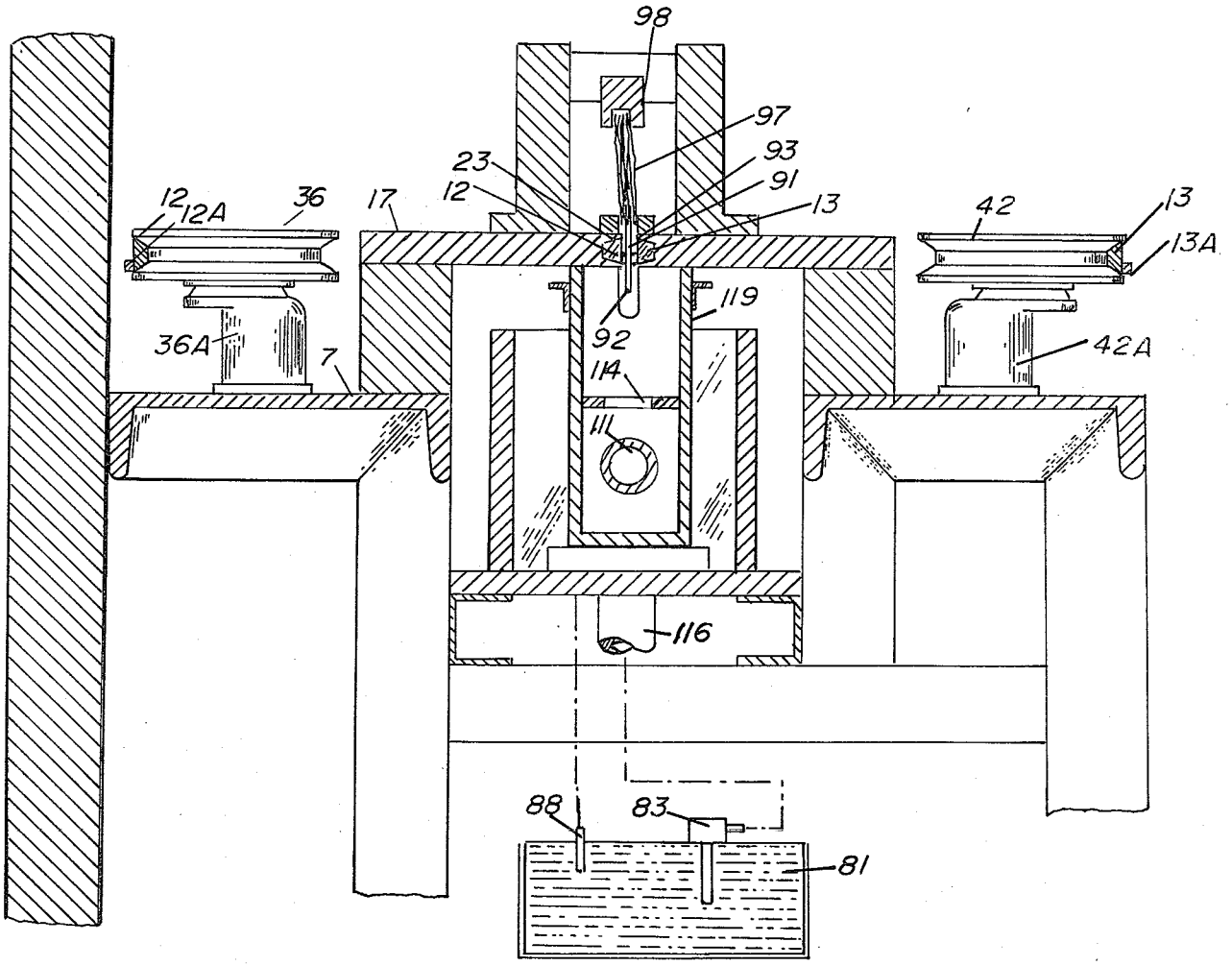
FIG. 5 is a cross section elevational view of an example of an apparatus within the scope of the present invention shown in FIG. 1 showing the orientation of transfer belts, solution cell, and parts to be electroplated taken along a plane passing through line 5—5 of FIG. 1.

Each of the pulleys 35–40 and 41–46 is carried by a spring biased mounting, for example mounting 36A, 42A as shown in some detail in FIG. 5 to provide tension for belts 12 and 13 maintain the belts in selected tension and in position in groove 23 of guides 17.

Referring again to FIG. 1 vents 54, 55 and 56 are provided in an upstanding wall 10 as shown for removal of fumes as indicated by arrows A whenever such fumes may be created where an exhaust system with an outlet 71 is provided in the unit for removal of the fumes to a suitable location for treatment and/or venting. In FIG. 1 a rectifier 61 and a rectifier 62 are provided respectively for, in this case, the electrocleaning sections and the gold plating sections as described hereinafter. Temperature controllers 63, 64 and 65 are provided to control the temperature in selected stations of the device as described hereinafter. Also a control panel 70 is provided for controlling overall operation of the unit.

An air connection 67, a water connection 68 and a drain 69 are provided to provide service to cells of various stations as described hereinafter.

Figure 3:
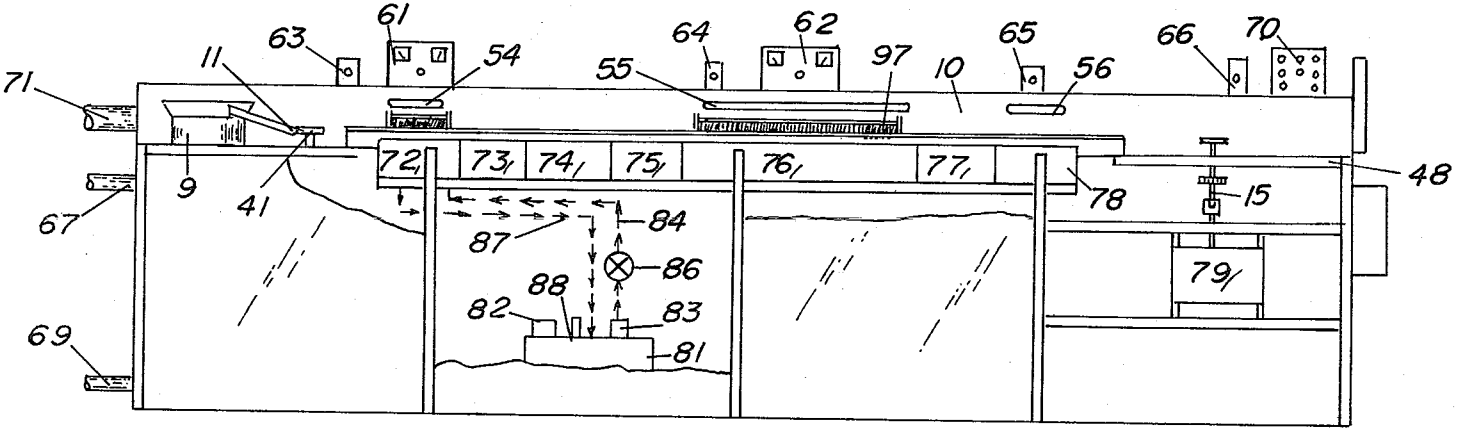
FIG. 3 is an elevational view of an arrangement in accordance with the present invention shown in FIG. 1 shown partially in section.

While the processing of parts may vary form application to application depending on the characteristic of the parts, as shown in FIG. 3 a typical device can include several processing stations including, in this case, an electroclean bath 72, rinse bath 73 and acid bath 74, a rinse bath 75, a goldplate bath 76, a dragout section 77, a hot rinse 78 and unload trap 48 as shown in FIG. 1. A drive motor 79 is provided to drive the parts transfer means including belt 12 and belt 13 by means pf a suitable drive chains 15. It will be understood that other processes can be included in devices within the scope of the present invention or that certain of the process stations included herein can be eliminated without departing from the scope of the present invention.

Each of the processing stations 72–78 in FIG. 3 includes a reservoir and pump for continuous circulation of selected fluid to a cell, within the scope of the present invention as described hereinafter, for control between the part and the liquid. However, only the reservoir and associated elements of the electroclean section 72 are shown in FIG. 3 but it will be understood that the section shown is typical of the others. Station 72 includes a reservoir 81 provided with a liquid level sensor 82 to prevent excessive liquid level in the reservoir as is known in the art. A pump 83 is provided to supply liquid from reservoir 81 through a conduit 84 and valve 86 to the cell (not shown in FIG. 3) of station 72. A drain 87 is provided from station 72 to return fluid to reservoir 81 for recirculation. A heater 88 is provided and operated by heat controller 63 by appropriate interconnection (not shown) for controlling the temperature of the liquid in reservoir 81. It will be recognized that each of the stations 72–78 includes a similar circulation system and as described hereinafter can be provided with similar cell configuration. However only the reservoirs for electroclean station 72 for goldplating station 76 and heat rinse station 78 are provided with heaters. In the case of station 76 the temperature is controlled by controller 64 and in the case of hot rinse 78 the temperature is controlled by controller 65.

In operation, parts loaded in bulk into are separated in feeder 9 where the parts are separated and travel down chute 11 in spaced relation in generally vertical orientation to be received between belts 12 and 13 for travel through the stations 72–78. In each case the parts 91 are received between the belts as shown in FIGS. 5 and 6 with a portion 92 extending downwardly from belts 12 and 13, for a selected distance and a second portion 93 which extends upwardly from the contact point between the belts.

Figure 6:
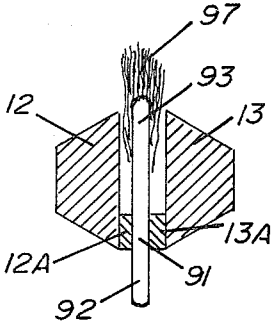
FIG. 6 is an enlarged cross section end view of a pair of transfer belts with a part to be plated held therebetween.
Figure 8:
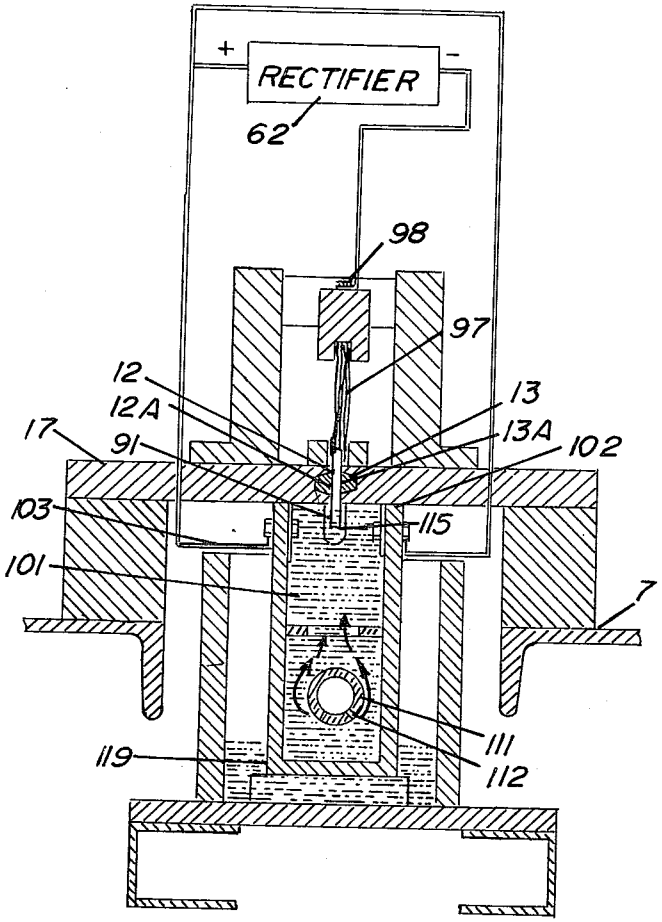
FIG. 8 is a view taken along a plane passing through line 8—8 of FIG. 7.
Figure 7:
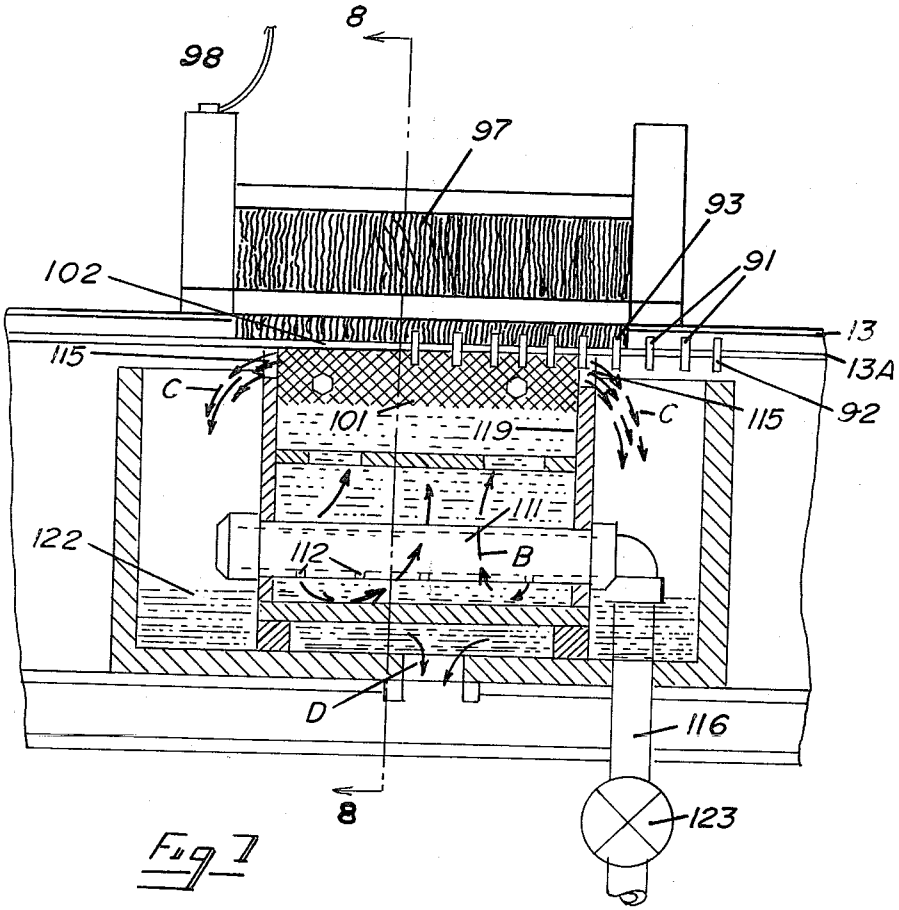
FIG. 7 is a cross sectional elevational view of an example of a solution cell and parts transfer arrangement within the scope of the present invention.

Referring to FIGS. 5 and 6 which present a view taken along a plane passing through line 5—5 of FIG. 1 and FIGS. 7 and 8 which are typical of the electroclean station 72 and the electroplating station 76, belts 12, 13 include lips 12A, 13A which actually receive the parts 91 therebetween. A contact for example an elongate brush cathode 97 is provided to extend along the length of each of the stations where electrolytic action is to occur such as the electroclean station 72 and the goldplate station 76 to provide an electrical circuit through the part into liquid of the associated station as described hereinafter. Cathode 97 in the example of the present invention shown, is a brush type connected by means of a lug 98 (FIG. 7) to a lead 99 which is supplied from one of the rectifiers 61, 62. For example, in the case of the drawing illustrated in FIG. 5 where the goldplate station 76 is shown the electrode lead is connected to rectifier 62.

As also shown in FIGS. 7 and 8 and described hereinafter an anode 101 provided for each of the cells where electrolytic action is to occur and may be of different length.

Figure 2:
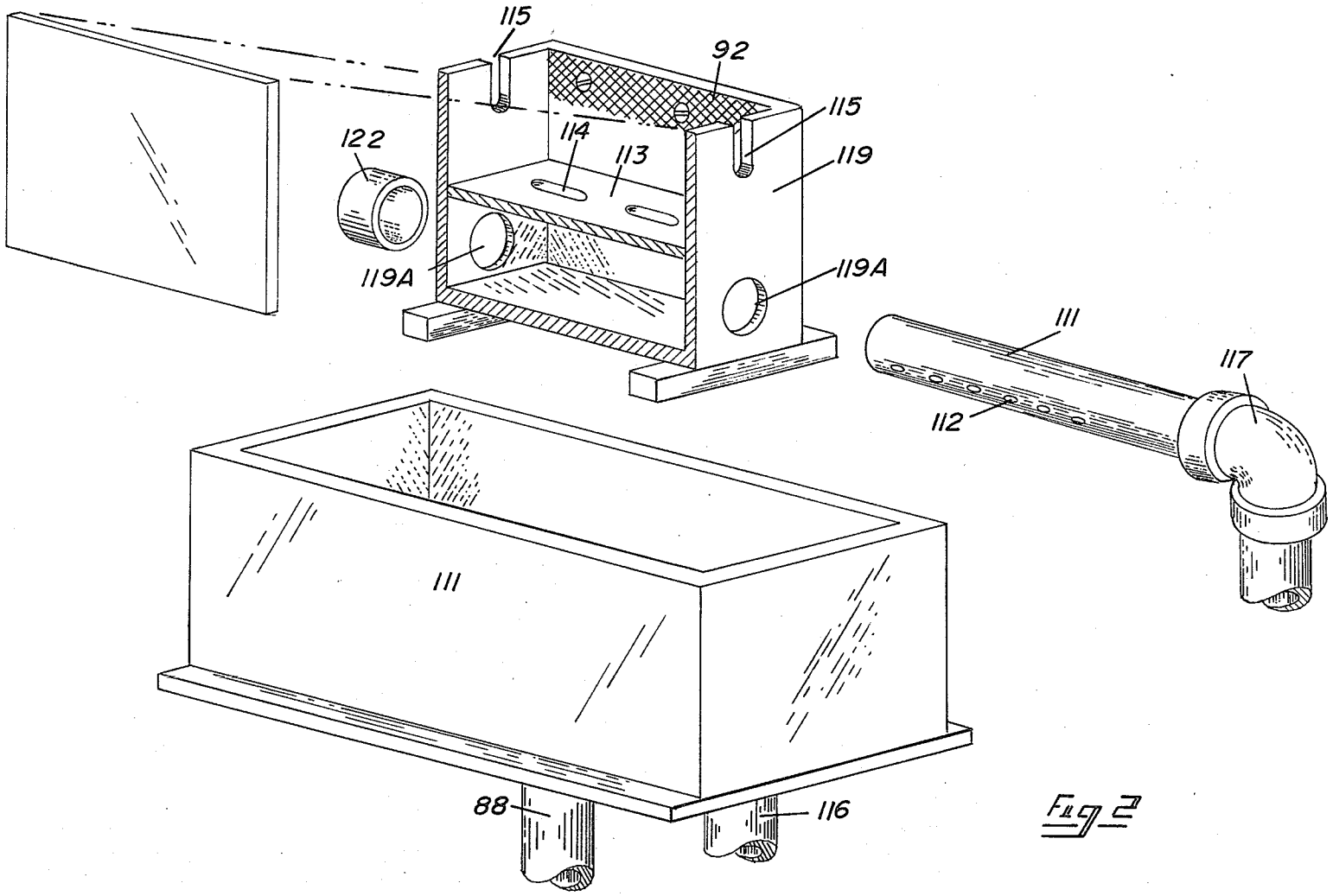
FIG. 2 is an exploded perspective view of a solution cell within the scope of present invention.
Figure 4:
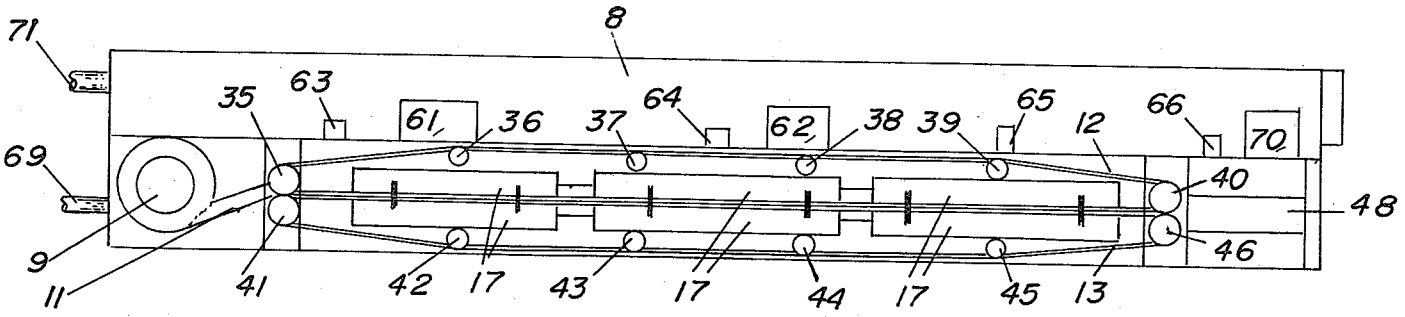
FIG. 4 is a plan view of the arrangement shown in FIG. 1.

As previously discussed each of the stations includes a cell for liquid for liquid contact with the parts to be pplated. Within the scope of present invention, the configuration of each cell is similar to that shown in FIG. 2 and the reference number utilized in describing the cell of FIG. 2 will be utilized in discussing the cell of all of the stations 72–78. In FIG. 2 an outer cell 111 is provided which, as shown can be generally rectangular. A drain 112 is provided in the center of the bottom 113 of the cell for emission of fluid from the cell. Fluid enters the cell by means of a conduit 116 communicating with an elbow 117 which communicates with a sparger 111 having apertures 112 therein and advantageously located in the bottom of an inner cell 119. Sparger 111 extends through inner cooperative apertures 119A of an cell 119 and carries a cap 122. As shown, a baffle plate 113 is provided having openings 114 where baffle 113 is located in cell 119 above the top of sparger 111 to control the flow of fluid into an upper portion of inner cell 119. Standoffs 115 are provided to allow clearance between the bottom of inner cell 119 and the bottom 113 of outer cell 111 for overflow of liquid from cell 119 to drain 112. In accordance with one feature of present invention upwardly open grooves 115 are provided at opposite sides of inner cell 119 to receive the articles to be plated, allow them to pass longitudinally in vertical relation through the inner cell 119 and out the opposite groove 115 as described hereinafter while the liquid in cell 119 overflows through the grooves. Anode connection 92 is shown in inner cell 119 of FIG. 2 but it will be understood that in the example of the present invention discussed herein the anodes would only be used at station 72 and 76.

The assembled arrangement shown in FIG. 2 is illustrated in cross section elevational view in FIG. 7 where the assembled form of the elements can be seen in position in operating device with a cathode and the transfer belts to show the relative position of parts 91 during the plating process. Fluid is admitted to cell 111 by means of inlet 116 and flows outwardly from apertures 112 of sparger 111 as shown by arrows B. The fluid fills cell 119 to a selected depth, for example shown by reference line 102 where the liquid overflows through upwardly open grooves 115 as shown by arrows C into the reservoir formed between cell 111 and 119 where a level, for example level 122 is maintained with fluid flowing outwardly from outer cell 111 through drain 112 as illustrated by arrows D.

For purposes of explanation belt 13 is shown carrying elongate parts 91 through inner cell 119 where sections 92 of the parts depend downwardly from contact strips 12,13 of the belts and are admitted through grooves 115 of cell 119 so segment 92 of each part 91 is immersed in the fluid in inner cell 119 as illustrated. The upper contact section 93 of each part in contact with cathode 97. It will be understood that the depth of immersion as well as the different levels of fluid in the inner and outer cells is dependent on the relative flow rates of the material into and out of cell 119 and cell 111 but the liquid level must be sufficient to maintain control with parts 91 as they pass through each cell between grooves 115.

As shown in FIG. 7 a valve 123 can be provide to control the flow of the plating solution into cell 111. It will be understood that conduit 116 is connected to a pump, reservoir and return assembly as shown in FIG. 3 with reference to the electroclean cell 72.

Likewise the length of the cell and the speed of travel of belts 12 and 13 as well as the current flow through the circuit provided through the cell by anode 101 and cathode 97 determines the degree of plating on the parts 91.

FIGS. 5 and 8 are end views in cross section of a typical cell, for example the cell of station 76, where FIG. 5 shows pulleys 36 and 42 where belts 12 and 13 are shown traveling around the pulleys 36 and 42 respectively. In FIG. 5 covers 17 are shown in place with belts 12, 13 located in guide grooves 23 in the sides of covers 17. Also as shown belts 12, 13 includes strip 12A, 13A, for example neoprene, to retain the parts to be plated therebetween. Cathode strip 97 is provided to extend selectively along the length of cell 76 where the contact portion 93 of the parts to be plated are held in contact with cathode strip 97 during travel through the cell where electroplating or electrolysis is to occur. Such as the electroclean station 72 and plating section 76 where electrolytic action also occurs.

In operation the parts to be plated are introduced into vibrator bowl 9, are orientated and passed through chute 11 in the configuration generally shown in FIGS. 5, 7 and 8 and commence to pass through the various stations of electroplating positioned between belts 12 and 13. In passing through the electrocleaning solution a contact portion 93 of the parts contact cathode 97 which the end 92 to be plated extends downwardly into the solution as shown in FIG. 7 for electrocleaning. The parts after passing through the electrocleaning stage are then rinsed in a station 73 which provides a cell similar to the cells previously described except for the fact that no electrolytic action occurs. The articles then pass through an acid reservoir 74 which includes a cell arrangement previously described holding, commonly, sulfuric or hydrochloric acid. The part is then rinsed in station 75 which includes cell similar to the cells previously described with reference to FIGS. 2 and 7 except that no electrical connections are provided. The parts are then passed to the goldplating station 76 were a plating solution which, although not per se comprising part of the present invention, commonly comprises an aqueous solution of an alkali-gold-cyanide together with suitable buffering compounds, conductivity salts and other agents as may be known in the art to be useful in promoting the production of high quality goldplating.

The plating as previously described occurs generally to the depth of immersion of the part as illustrated in FIG. 6 and can be utilized to plate even the inside of tubular parts as described hereinafter.

Upon emission from the cell of station 76 the articles are passed through a dragout station 77 which provides a wiper means for recovery of plating solution from the surface of the article, as is known in the art. The article is then passed through a hot rinse station 78 once again including a cell similar to the cells previously described to rinse the particle and thence to unloading trap 48 as a finished product.

FIGS. 13A–13E are illustrations of various types of articles which can be plated in devices in accordance with the present invention.

It will be noted that each of the parts is elongate and can be selectively positioned between belts 12 and 13 to provide an upper contact area and a lower segment to be plated.

Figure 14B:
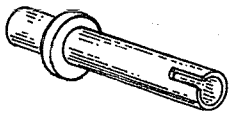
FIGS. 14A–14B are perspective views of a tubular part which can be processed by the present invention.
Figure 12A:
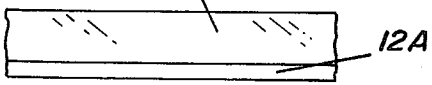
FIGS. 12A–12C are three views of a transfer belt useful in the present invention.
Figure 12C:
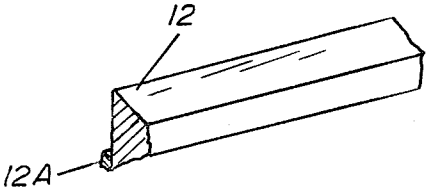
Figure 12B:
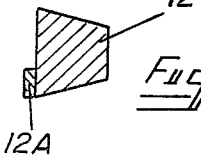
Figure 14A:
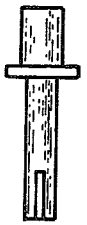

FIGS. 14A,14B illustrate a hollow tubular connector where a plating can be applied to the inner surface of the part by the apparatus provided by the present invention.

Specifically, the part shown in FIGS. 14A,14B is useful to receive a contact in the hollow passageway provided therein. There is need for plating in the tube but not in the outer surface.

Figure 9:
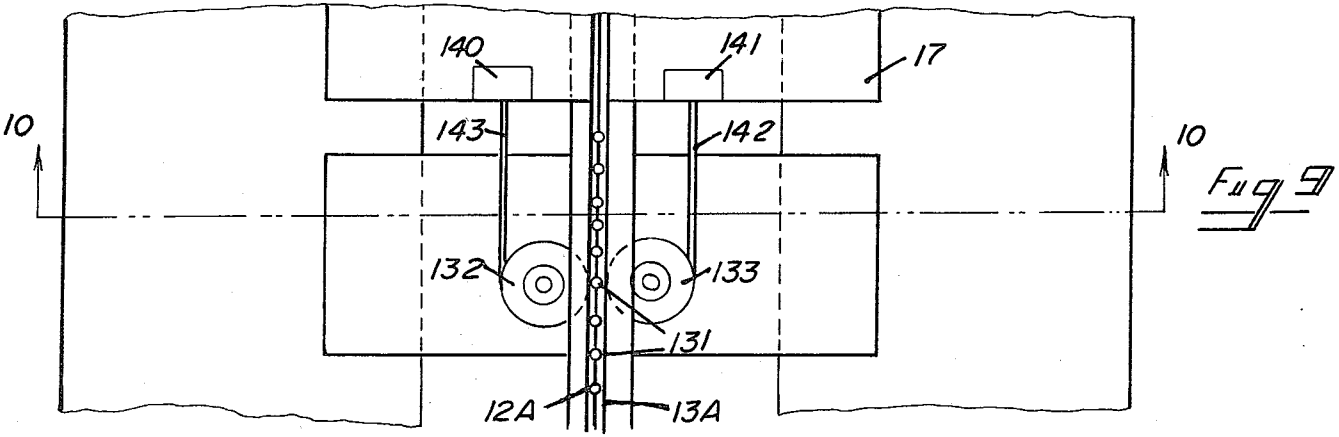
FIG. 9 is a plane view of a masking system useful in devices in accordance with the present invention.
Figure 10:
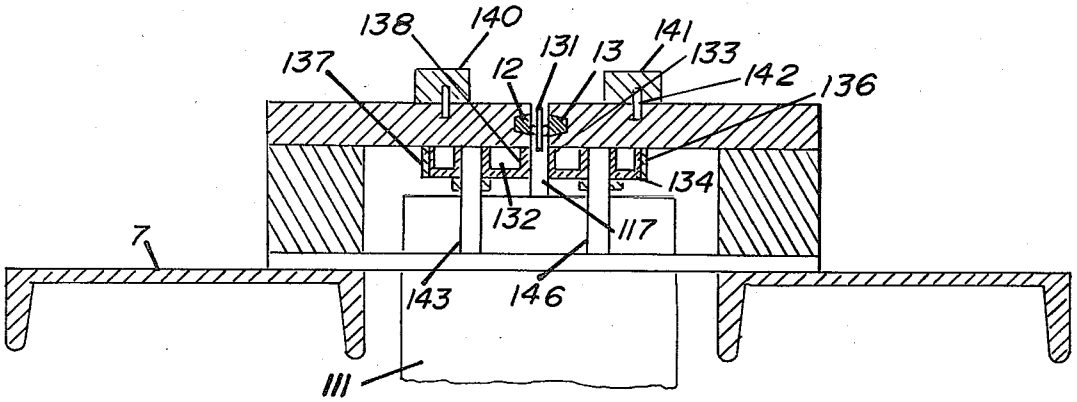
FIG. 10 is an elevational view taken along a plane passing through line 10—10 of FIG. 9.

Accordingly, a method as illustrated in FIGS. 9 and 10 is utilized.

FIG. 9 is a top view of a device within the scope of the present invention which can be adapted to coat the outer surface of a part hollow or tubular part 131 prior to introduction to the electroplating station 76 where the part as shown in FIG. 10 is carried between belts 12 and 13 through a nip between rollers 132, 133 which can be rotable at selected speed by motive means not shown. Rollers 132 and 133 are in peripheral contact at the nip. The periphery of each of the rollers 132,134 is provided with an absorbant covering 136,137. Roller 134 is provided with peripheral apertures 138 to allow for flow of a selected liquid from reservoir 134 to covery 136 which flows to the surface covering 136 and is applied to covering 137. The selected liquid, for example a wax base liquid which is nonconductive and generally insoluble in the liquid of the electroplating section and applied to the outer surface of part 131, for example the tubular part shown in FIGS. 14A–14D as it passes through the nip between rollers 132,133 so that the plating is accomplished only in uncovered areas, namely the inside of the tubular part to the depth of immersion in the cell of electroplating section 76.

It will be understood that the foregoing is but one example of method and apparatus within the scope of the present invention and that various other methods and apparatus also within the scope of the present invention will occur to those skilled in the art upon reading the disclosure set forth herein.

The invention claimed is:

1. Apparatus for electrically processing selected portions of elongate metallic articles to selectively electroplate a first portion including elongate moving transport means for travel along a selected path above a reservoir containing electroplating solution to retain said articles wherein said transport means including co-operating longitudinally aligned first and second conveyor belt means wherein selected portions of said first and second conveyor belt means are located in mutually opposed relation above said reservoir means wherein contact strips are provided on the opposed surfaces of said first and second belt means to extend outwardly from said first and second belts to engage each other and hold said articles to be electroplated therebetween and define a space between said first and second belt means to receive a second portion of said articles to be electroplated and where said articles to be electroplated are held between said first and second conveyor belt means with said first portion disposed in said electroplating solution and a second portion of each said article extends outwardly from an opposite side of said transport means, contact means disposed to contact said second portion of said articles when said first portion of said articles are located in said solution and source of direct current to be applied between said contact means and said electroplating means solution so current flows between said contact means through said article and said electroplating solution.

2. The invention of claim 1 wherein said reservoir means includes a chamber defined by cooperating wall means, upwardly open groove means located in aligned relation on opposite sides of said wall means wherein said transport means is disposed to direct said first portion of said articles to be electroplated through said first and second groove means.

3. The invention of claim 2 including solution supply and control means to maintain a level of solution within said chamber so that said solution flows outwardly through said first and second upwardly open groove means and sufficient to maintain contact between said first portion of said articles to be electroplated and said solution.

4. The invention of claim 3 wherein said reservoir means is located within second reservoir means to receive solution overflowing from said reservoir means.

5. The invention of claim 2 including sparger means disposed beneath said first and second upwardly open groove means to direct solution into said reservoir means whereby said solution overflows through said first and second groove means into said second reservoir means.

6. The invention of claim 5 including baffle means located transversely across said reservoir means between said sparger means and said first and second upwardly open gear means and having apertures therein to selectively direct flow of said solution with respect to said first and second groove means.

7. The invention of claim 1 wherein said contact means is relatively electrically negative with respect to said solution.

8. The invention of claim 1 including anode means located within said reservoir to maintain said solution in electrically positive potential with respect to said contact means.

9. The invention of claim 1 including liquid supply means to apply a selected liquid to said first portion of said articles to be electroplated prior to introduction of said articles to be electroplated into said reservoir means.

10. The invention of claim 9 wherein said means to apply said liquid to said articles includes a generally opposed pair of rotatable wheel means located to form a nip therebetween and located to receive said first portion of said articles at said nip prior to introduction of said articles into said reservoir.

11. The invention of claim 10 wherein said liquid to be applied is insoluble in said electroplating solution and is electrically conductive.

12. The invention of claim 11 wherein said wheel means include porous pad means on the periphery thereof in mutual contact.

13. The invention of claim 12 including means to selectively provide liquid to said porous pad means.

14. The invention of claim 13 wherein said reservoir is of selected length between said first and second upwardly open groove means and where said contact means extends generally from said first groove to said second groove.

15. The invention of claim 14 wherein said contact means is flexible brush type means to contact said second portion of said articles.

* * * * *